United States Patent [19]

Han et al.

[11] Patent Number: 4,934,544

[45] Date of Patent: Jun. 19, 1990

[54] Z-TAB INNERSEAL FOR A CONTAINER AND METHOD OF APPLICATION

[75] Inventors: Hak-Rhim Han, Newport; Theresa A. McCarthy, W. St. Paul, both of Minn.

[73] Assignee: Minnesota Mining and Manufacturing Company, St. Paul, Minn.

[21] Appl. No.: 314,393

[22] Filed: Feb. 27, 1989

[51] Int. Cl.[5] ..... B65D 55/02

[52] U.S. Cl. ..... 215/232; 215/298; 220/270; 220/359

[58] Field of Search ..... 215/232, 234, 250, 257; 220/265, 270, 285, 359

[56] References Cited

U.S. PATENT DOCUMENTS

| | | | |
|---|---|---|---|
| 713,824 | 11/1902 | White, Jr. . | |
| 745,195 | 11/1903 | Kimsey | 215/298 |
| 756,601 | 4/1904 | Doremus | 215/298 |
| 830,735 | 9/1906 | Olsson | 215/298 |
| 895,719 | 8/1908 | Bradley | 215/298 |
| 902,843 | 11/1908 | Sheppard | 215/298 |
| 1,073,071 | 9/1913 | Hall | 215/298 |
| 2,050,248 | 8/1936 | Eisen | 154/45.5 |
| 2,077,992 | 4/1937 | Eisen | 215/347 |
| 2,131,775 | 10/1938 | Waring | 215/250 |
| 2,188,946 | 2/1940 | Gutmann | 215/40 |
| 2,620,939 | 12/1952 | Weisgerber | 215/40 |
| 2,646,183 | 7/1953 | Pellett | 215/40 |

(List continued on next page.)

FOREIGN PATENT DOCUMENTS

| | | |
|---|---|---|
| 040797 | 5/1981 | European Pat. Off. . |
| 045262 | 7/1981 | European Pat. Off. . |
| 109592 | 4/1983 | European Pat. Off. . |
| 109593 | 4/1983 | European Pat. Off. . |
| 111900 | 12/1983 | European Pat. Off. . |
| 128434 | 5/1984 | European Pat. Off. . |
| 135431 | 8/1984 | European Pat. Off. . |
| 1246995 | 4/1964 | Fed. Rep. of Germany . |
| 1281677 | 2/1965 | Fed. Rep. of Germany . |
| 2622012 | 5/1976 | Fed. Rep. of Germany . |
| 3311170 | 3/1983 | Fed. Rep. of Germany . |
| 2327161 | 10/1975 | France . |
| 209616 | 7/1940 | Switzerland . |
| 659633 | 12/1978 | Switzerland . |
| 283050 | 1/1928 | United Kingdom . |
| 1495386 | 12/1973 | United Kingdom . |
| 1511250 | 11/1974 | United Kingdom . |
| 1576373 | 3/1977 | United Kingdom . |
| 2052726 | 7/1979 | United Kingdom . |
| 2072131 | 3/1981 | United Kingdom . |
| 2177974 | 7/1986 | United Kingdom . |

OTHER PUBLICATIONS

Mylar® for Packaging–Summary of Properties, 2-page Brochure from Dupont.

"Increase Packaging Efficiency and Package Performance", Dupont Co. Polymer.

"Cap-Seal® Closure Liners", 2-page Brochure from 3M Packaging Systems Division.

"There's a Unipac Induction seal just right for every application", 1-page Brochure from Insulec, Ltd.

*Primary Examiner*—Stephen Marcus

*Assistant Examiner*—Christine A. Peterson

*Attorney, Agent, or Firm*—Merchant, Gould, Smith, Edell, Welter & Schmidt

[57] ABSTRACT

A z-tab innerseal for a container and method of application involves an innerseal having a first sealing portion for sealing a first portion of an opening defined by an upper rim of a container, a second sealing portion for sealing the remainder of the container opening and a flap portion between the first and second sealing portions which is adapted to be grasped and pulled upwardly by a user to remove the innerseal from the container opening. An advantage of the flap portion is that it allows the innerseal to be removed without having to penetrate or scrape the innerseal with a sharp object such as a knife. A method of forming the improved innerseal includes providing a blank of stock material having a folded portion, cutting the blank to form an innerseal, mounting the innerseal onto the rim of a container and sealing the innerseal to the container by passing the assembly through a heating station.

30 Claims, 3 Drawing Sheets

U.S. PATENT DOCUMENTS

| | | | |
|---|---|---|---|
| 2,937,481 | 5/1960 | Palmer | 53/39 |
| 3,032,225 | 5/1962 | Harding | 215/250 |
| 3,202,308 | 8/1965 | Botkin | 215/40 |
| 3,317,068 | 5/1967 | Betner | 215/39 |
| 3,330,720 | 7/1967 | Stevens et al. | 161/162 |
| 3,389,827 | 6/1968 | Abere et al. | 220/53 |
| 3,489,307 | 1/1970 | Wenger | 215/40 |
| 3,501,042 | 3/1970 | Risch et al. | 215/40 |
| 3,549,440 | 12/1970 | Adcock et al. . | |
| 3,565,247 | 2/1971 | Brochman | 206/59 |
| 3,632,004 | 1/1972 | Grimes et al. | 215/40 |
| 3,637,101 | 1/1972 | Risch et al. | 215/40 |
| 3,900,125 | 8/1975 | Wyler et al. | 215/341 |
| 3,923,198 | 12/1975 | Brochman | 220/359 |
| 3,963,845 | 6/1976 | Dukess | 215/347 |
| 3,964,415 | 6/1976 | Viker et al. | 113/121 C |
| 3,990,603 | 11/1976 | Brochman | 220/260 |
| 4,044,941 | 8/1977 | Knudsen | 229/43 |
| 4,089,434 | 5/1978 | Tagalakis et al. | 215/260 |
| 4,108,330 | 8/1978 | Patterson | 220/260 |
| 4,121,728 | 10/1978 | Tagalakis et al. | 215/260 |
| 4,135,637 | 1/1979 | Hannula | 220/270 |
| 4,155,439 | 5/1979 | Fletcher et al. | 198/339 |
| 4,163,506 | 8/1979 | Patterson | 220/260 |
| 4,189,060 | 2/1980 | Trotman, III | 220/260 |
| 4,215,791 | 8/1980 | Brochman | 220/258 |
| 4,256,234 | 3/1981 | Mori et al. | 215/343 |
| 4,256,528 | 3/1981 | Patterson | 156/514 |
| 4,315,047 | 2/1982 | Seabold et al. | 428/64 |
| 4,324,601 | 4/1982 | Dembicki et al. | 215/232 |
| 4,372,460 | 2/1983 | Brochman et al. | 220/258 |
| 4,373,978 | 2/1983 | Patterson | 156/69 |
| 4,378,074 | 3/1983 | Brochman | 220/260 |
| 4,390,552 | 6/1983 | Niwa | 426/126 |
| 4,405,056 | 9/1983 | Patterson | 220/271 |
| 4,423,819 | 1/1984 | Cummings | 215/232 |
| 4,424,911 | 1/1984 | Resnick | 215/365 |
| 4,436,213 | 3/1984 | Paul, Jr. et al. | 215/365 |
| 4,442,129 | 4/1984 | Niwa et al. | 426/399 |
| 4,445,620 | 5/1984 | Brochman et al. | 220/271 |
| 4,448,326 | 5/1984 | Brochman | 220/270 |
| 4,452,842 | 6/1984 | Borges et al. | 220/359 X |
| 4,454,956 | 6/1984 | Patterson | 220/214 |
| 4,462,502 | 7/1984 | Luenser et al. | 215/329 |
| 4,463,116 | 7/1984 | Koyama et al. | 524/232 |
| 4,469,754 | 9/1984 | Hoh et al. | 428/476.3 |
| 4,500,011 | 2/1985 | Brochman | 220/359 |
| 4,501,371 | 2/1985 | Smalley | 215/232 |
| 4,514,248 | 4/1985 | Cummings | 215/232 X |
| 4,526,562 | 7/1985 | Knudsen et al. | 493/80 |
| 4,527,703 | 7/1985 | Cummings | 215/232 |
| 4,537,327 | 8/1985 | Lu | 220/359 |
| 4,557,505 | 12/1985 | Schaefer et al. | 283/81 |
| 4,564,121 | 1/1986 | Brochman | 220/359 |
| 4,565,738 | 1/1986 | Purdy | 428/349 |
| 4,576,297 | 3/1986 | Larson | 215/250 |
| 4,577,777 | 3/1986 | Brochman | 220/359 |
| 4,579,240 | 4/1986 | Ou-Yang | 215/230 |
| 4,588,099 | 5/1986 | Diez | 215/232 |
| 4,595,114 | 6/1986 | Lu | 220/260 |
| 4,595,434 | 6/1986 | Eckstein et al. | 156/69 |
| 4,596,338 | 6/1986 | Yousif | 215/232 |
| 4,625,875 | 12/1986 | Carr et al. | 215/232 |
| 4,650,082 | 3/1987 | Paciorek | 215/230 |
| 4,666,052 | 5/1987 | Ou-Yang | 215/230 |
| 4,673,601 | 6/1987 | Lamping et al. | 428/35 |
| 4,684,554 | 8/1987 | Ou-Yang | 215/232 X |
| 4,693,390 | 9/1987 | Hekal | 220/359 |
| 4,722,447 | 2/1988 | Crisci | 215/232 |
| 4,733,786 | 3/1988 | Emslander | 215/230 |
| 4,735,335 | 4/1988 | Torterotot | 220/270 |
| 4,754,890 | 7/1988 | Ullman et al. | 215/232 |
| 4,762,246 | 8/1988 | Ashley et al. | 220/270 |
| 4,778,698 | 10/1988 | Ou-Yang | 215/232 |
| 4,801,041 | 1/1989 | Takata et al. | 220/270 X |
| 4,810,541 | 3/1989 | Newman et al. | 220/359 X |

Z-TAB INNERSEAL FOR A CONTAINER AND METHOD OF APPLICATION

BACKGROUND OF THE INVENTION

1. Field of the Invention

This invention relates to container innerseals which are used to provide an airtight seal for containers. More specifically, the invention relates to an improved innerseal for a container which is easier to remove, and promotes ease of removal in conjunction with improved sealability for containers on which it is applied relative to those innerseals which were heretofore known.

2. Description of the Prior Art

In view of the need in contemporary society for airtight, hermetic seals on containers for food, medicine and the like, closures have been developed which incorporate an innerseal bonded to an upper rim of the container. To effect such a seal, a filled container after being capped is passed through an electromagnetic field generated by induction heating equipment, which heats a foil layer within the innerseal, thereby bringing about the melting of a heat sealable polymeric film coating. One system of this type which has met with significant commercial success bears the trademark "Safe-Gard", and is manufactured by the Minnesota Mining and Manufacturing Company of St. Paul, Minn. This system provides a hermetic seal that is suitable for use with ingestible commodities. The seal is particularly effective for products which should be preferably kept free from contamination, oxidation and/or moisture. However, it is difficult to effectively control the adhesive force by which such innerseals are bonded to the containers, due to the dependency of the sealing force on the amount of inductive power that is applied. Accordingly, it has previously been necessary to maintain strict control over the amount of power that is applied during sealing of such containers, and a wide range of seal tightness may result even if the power range is effectively controlled. Moreover, the amount of sealing force which could be used was limited by the fact that an equal amount of force was needed to remove the innerseal from the container by the end user. As a result such seals had to be penetrated or scraped off with a sharp implement such as a knife. This problem was compounded by the inconsistency of sealing forces from container to container and the limitations on sealing force as discussed above.

Although innerseals which have integral tab portions for gripping purposes have been developed, as is disclosed in U.S. Pat. No. 4,754,890 to Ullman et al., the basic problem of grippability in conjunction with a limited and unpredictable range of sealing forces has not been effectively solved to date. It is within this context that the present invention assumes significance.

It is clear that there has existed a long and unfilled need in the prior art for container innerseals which are easily removable by an end user without scraping or puncturing, and that have a consistent removal force which allows a strong seal to be provided between the innerseal and container regardless of the sealing force, and that obviates the need for strict control during the sealing process.

SUMMARY OF THE INVENTION

According to the invention, an improved container assembly of the type having an innerseal for providing an additional seal between an inner portion thereof and an outside space includes a container having an opening defined therein by an upper rim thereof; a first sealing structure adapted for sealing over a first portion of the upper rim to close a first portion of the opening; a second sealing structure adapted for sealing over a second portion of the upper rim to close a second remaining portion of the opening; and a flap structure positioned between the first and second sealing structures and adapted for gripping by a user, whereby the innerseal may be removed from the container without the aid of a scraping or puncturing tool.

According to a second aspect of the invention, a method for forming an improved container assembly includes the steps of providing a layered material including a lower sealing layer and a fluid passage prevention layer, the layered material being folded over upon itself in a intermediate portion thereof; cutting the layered material in a pattern corresponding to the opening, whereby the folded over portion forms the flap structure; applying the innerseal over the opening defined by the upper rim of the container in such a manner that the first sealing structure covers the first portion of the opening and the second sealing structure covers the second portion of the opening, the flap structure being positioned between the first and second sealing structures in such a manner as to be adapted for grasping by a user; and sealing the first and second sealing structures to the upper rim of the container, whereby the container is covered by an airtight, easy to remove innerseal.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
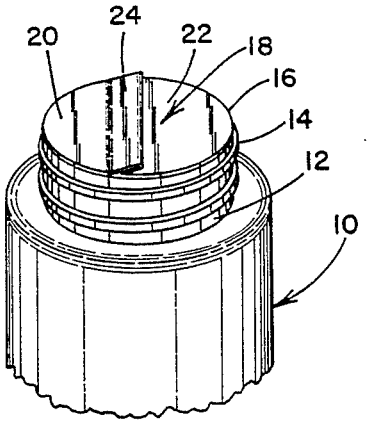
FIG. 1 is a perspective view of an improved container assembly constructed according to the invention.
Figure 2:
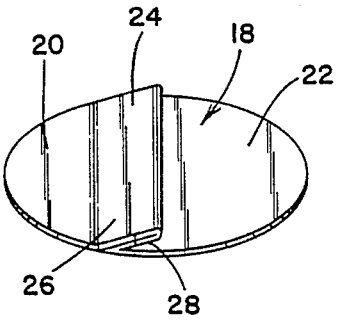
FIG. 2 is a perspective view of an innerseal portion of the embodiment illustrated in FIG. 1.

Referring to the drawings, wherein like reference numerals designate corresponding structure throughout the views, and particularly referring to FIG. 1, a container 10 includes a neck portion 12 having threads 14 formed therein. An opening is defined in container 10 by rim 16, which is formed at an upper extremity of neck portion 12.

An innerseal 18 is mounted so as to seal the opening defined by rim 16, as is shown in FIG. 1. Innerseal 18 includes a first sealing portion 20 which seals a first portion of the opening, a second sealing portion 22 which seals a remaining second portion of the opening and a fold-over portion 24 which is positioned between the first sealing portion and the second sealing portion 22. In the preferred embodiment, first sealing portion 20, second sealing portion 22 and fold-over portion 24 are all formed from a single continuously extending sheet of common layered material, with fold-over portion 24 including a first flap 26 which is contiguous with first sealing portion 20 and a second flap 28 contiguous with second sealing portion 22. First and second flaps 26, 28 are preferably formed of a length that is sufficient to enable fold-over portion 24 to be grasped by an end user, so that innerseal 18 may be removed from the container 10. When a threaded cap is secured upon neck portion in a manner that is well-known throughout the art, fold-over portion 24 is disposed in a position parallel to the first and second sealing portions 20, 22, and lies against an upper surface of second sealing portion 22. When it is desired to remove the innerseal 18, an end user may insert his or her fingernail between second sealing portion 22 and fold-over portion 24 to lift fold-over portion 24 to the position that is illustrated in FIG. 1. Fold-over portion 24 may then be grasped and removed by the end user.

Figure 3:
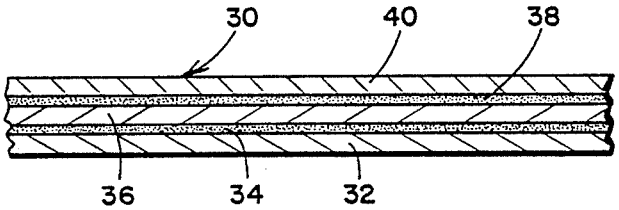
FIG. 3 is a fragmentary cross-sectional view of a first embodiment of the innerseal illustrated in FIG. 2.

Referring now to FIG. 3, a first embodiment 30 for the common layered material used in forming innerseal 18 is shown. Layered material 30 includes a bottom sealing layer 32 which is for sealing innerseal 18 onto the rim portion 16 of container 10. A metallic layer 36 is provided for preventing passage of fluid through layered material 30 and for heating the layered material in response to an induction heater to seal layer 32 onto rim portion 16, as will be below described. Metallic layer 36 is bonded to sealing layer 32 by a first adhesive layer 34. An optional layer 40 may be laminated onto a top surface of metallic layer 36 by a second adhesive layer 38 for aesthetic purposes.

Sealing layer 32 is preferably formed of a polymeric film which is between 1 and 1.5 mils in thickness. Examples of the materials which may be used to form sealing layer 32 are polyethylene, polypropylene, ethylene vinyl acetate, Surlyn brand 1702 resin or a laminate of polyethylene and a 0.5 mil layer of polyester. The purpose of sealing layer 32 is to be heat bondable to rim 16 with a bonding force which is less than the rupture force of sealing layer 32. First adhesive layer 34 may be formed of any adhesive capable of bonding the materials discussed above in regard to sealing layer 32 to metallic layer 36, and is preferably formed of Adcote 503A adhesive, which is available from Morton Norwich Products, Inc. of Chicago, Ill. Metallic layer 36 is preferably formed of aluminum and is in the preferred embodiment between 1–3 mils in thickness. Optional layer 40 may be formed of any material which might be more aesthetically pleasing than the upper surface of metallic layer 36 or from a material upon which a pattern may be printed, such as a paper or polymeric film. Second adhesive layer 38 may be formed of any substance capable of bonding metallic layer 36 to optional layer 40, and is preferably composed of Adcote 503A.

Four preferred examples of layered material 30 which had been prepared and have been found to achieve satisfactory results when used in conjunction with a polyethylene container 10 will now be detailed:

Example 1

In this sample, sealing layer 32 is formed from a film of Scotchpak TM 113 film having a thickness of between 1–1.5 mils. Scotchpak TM 113 is formed of ethylene vinyl acetate and 0.5 mil layer of polyester, and is available from the 3M Company of St. Paul, Minn. Metallic layer 36 is formed from aluminum foil having a thickness of 2 mils which is commercial available from the Aluminum Company of America of Davenport, Iowa. First adhesive layer 34 is formed of Adcote 503A laminating adhesive. In this sample, second adhesive layer 38 and optional layer 40 are not included.

Example 2

In this sample, sealing layer 32 is formed of a Scotchpak TM 113 film having a thickness of between 1–1.5 mils. First adhesive layer 34 is formed of Adcote 503A laminating adhesive. Metallic layer 36 is formed of aluminum foil having a thickness of approximately 3 mils. In this sample, optional layer 40 and second adhesive layer 38 are not included.

Example 3

In this third sample, sealing layer 32 is formed of Scotchpak TM 107 film, which is between 1–1.5 mils in thickness and includes a 0.5 mil layer of polyester and a second layer of polyethylene. Scotchpak TM 107 film is commercially available from the Minnesota Mining and Manufacturing Company of St. Paul, Minn. First adhesive layer 34 is formed of Adcote 503A laminating adhesive. Metallic layer 36 is formed of aluminum foil having a thickness of approximately 1 mil. Optional layer 40 and second adhesive layer 38 were not included in this sample.

Example 4

In this sample, sealing layer 32 is formed of a film of Surlyn brand 1702 resin having a thickness of approximately 1.5 mils. First adhesive layer 34 is formed of Adcote 503A adhesive. Metallic layer 36 is formed of a sheet of aluminum foil having a thickness of approximately 1.5 mils. No optional layer 40 or second adhesive layer 38 were provided in this sample.

Figure 4:
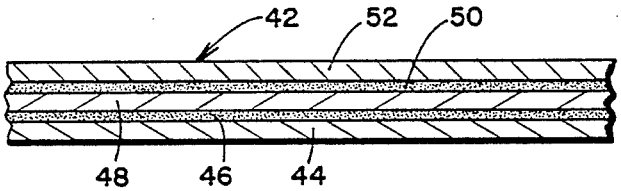
FIG. 4 is a fragmentary cross-sectional view of a second embodiment of the innerseal illustrated in FIG. 2.
Figure 5:
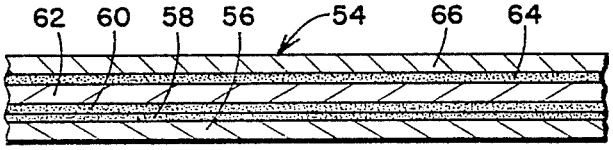
FIG. 5 is a fragmentary cross-sectional view of a third embodiment of the innerseal illustrated in FIG. 2.
Figure 6:
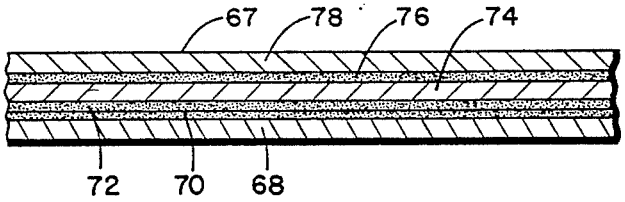
FIG. 6 is a fragmentary cross-sectional view of a fourth embodiment of the innerseal illustrated in FIG. 2.

In the embodiments which are illustrated in FIGS. 4–6, the innerseal is provided with a bonding arrangement which has a first bonding portion and a second bonding portion. The first bonding portion is designed to bond to rim 16 with a first bonding force which is greater than a second bonding force which bonds the first and second bonding portions together. The first bonding portion has a rupture strength which is less than either the first or second bonding force. A third bonding force between the bonding arrangement and the remainder of the innerseal is greater than the second bonding force. As a result, an innerseal constructed according to the embodiments or FIGS. 4–6 will be removed in the internally delaminating, controlled removal force manner illustrated in FIG. 9.

Referring now to FIG. 4, a layered material 42 constructed according to a second embodiment of the invention will now be discussed. Layered material 42 includes a bonding arrangement consisting of a first bonding portion which is embodied as sealing layer 44 and a second bonding portion embodied as adhesive layer 46, which bonds layer 44 to a metallic layer 48. An optional layer 52 may be bonded to an upper surface of metallic layer 48 by an adhesive layer 50 for aesthetic purposes. Sealing layer 44 is preferably formed of a polymeric film having a thickness of between 0.5–1.5 mils. Materials which may be used to form sealing layer 44 include polyethylene, polypropylene, ethylene vinyl acetate, Surlyn brand 1702 resin or, polyester of 50 OL-2 Mylar brand film, for use when container 10 is fabricated of PVC. Adhesive layer 46 may be formed of any adhesive capable of bonding the materials mentioned above in regard to sealing member 44 to a metallic substance, such as Adcote 503A adhesive. Metallic layer 48 is preferably formed of aluminum or an equivalent material which can be heated inductively and is effective in preventing passage of fluid therethrough. Optional layer 52 and adhesive layer 50 are formed of materials identical to those discussed above in reference to optional layer 40 and adhesive layer 38 in the embodiment depicted in FIG. 3, respectively.

Examples of specific embodiments for layered material 42 which have been constructed and have proven to be satisfactory will now be discussed:

Example 5

In this sample, which is intended for use when container 10 is formed of polyester or polyvinyl chloride, sealing layer 44 is formed of a sheet of 50 OL-2 Mylar brand film having a thickness of approximately 0.5 mils. Adhesive layer 46 is preferably formed of Adcote 503A laminating adhesive. Metallic layer 48 is formed of a sheet of aluminum foil having a thickness of approximately 1 mil. This sample did not include an optional layer 52 or adhesive layer 50.

Referring now to FIG. 5, a layered material 54 constructed according to a third embodiment of the invention includes a bonding arrangement having a first bonding portion embodied as sealing layer 56, a second bonding portion embodied as a layer of pressure sensitive adhesive 58, a primer layer 60, a metallic layer 62, an optional layer 66 and an adhesive layer 64 for bonding optional layer 66 to metallic layer 62. Sealing layer 56 is preferably formed of a polymeric film such as polyethylene, polypropylene, ethylene vinyl acetate, Surlyn brand 1702 resin or an equivalent material, and is between 1–1.5 mils in thickness. Layer 58 may be formed out of any suitable pressure sensitive adhesive, such as natural rubber, and is preferably 0.1–0.2 mils in thickness. Layer 60, which is between 0.01–0.05 mils in thickness, is formed of a suitable primer, such as CP 343-1 primer which is commercially available from the Eastman Chemical Corporation, in Kingsport, Tenn. Metallic layer 62 is formed of aluminum or a suitable alternative material which can be heated inductively and is effective at preventing passage of fluid therethrough. The optional aesthetic layer 66 and adhesive layer 64 are formed of materials identical to those discussed above with reference to layers 40, 38, respectively, in the embodiment illustrated in FIG. 3.

An example of a layered material 54 which has been constructed and has proven satisfactory will now be detailed:

Example 6

In this sample, which is intended for use when container 10 is formed of polyethylene, sealing layer 56 is formed of a polyethylene film having a thickness of approximately 1 mil. Adhesive layer 58 is formed of Kraton® elastomeric copolymer, which is commercially available from Shell Chemical Company of Oak Brook, Ill. Primer layer 60 is formed of Eastman CP-343-1 primer. Metallic layer 62 is formed of a sheet of aluminum foil having a thickness of approximately 1 mil.

Example 7

In this sample, which is intended for use when container 10 is formed of polyethylene, sealing layer 56 is formed of a layer of polyethylene film having a thickness of approximately 1 mil. Layer 58 is formed of a natural rubber pressure sensitive adhesive having a thickness of 0.1–0.2 mils. Layer 60 is formed of Eastman CP 343-1 primer and has a thickness of 0.01–0.05 mils. Metallic layer 62 is formed of a sheet of aluminum foil having a thickness of approximately 1 mil. Optional layer 66 and adhesive layer 64 were not included in this sample.

Referring now to FIG. 6, a layered material 67 constructed according to a fourth embodiment of the invention includes a bonding arrangement having a first bonding portion embodied as sealing layer 68, a second bonding portion embodied as a layer 70 of pressure sensitive adhesive, a layer 72 of polymeric film, a layer 74 of metallic foil, a layer 76 of adhesive material and an optional layer 78 which may be provided for aesthetic purposes. Sealing layer 68 is preferably formed of a polymeric film having a thickness of between 1–1.5 mils. Materials which could be used to form sealing layer 68 include polyethylene, polypropylene, ethylene vinyl acetate, Surlyn brand 1702 resin or other known equivalents. Layer 70 is formed of a pressure-sensitive adhesive such as natural rubber, and has a preferred thickness within the range of 0.1–0.2 mils. The layer 72 of polymeric film is preferably formed of polypropylene or an equivalent material and has a thickness of approximately 1.5 mils. Metallic foil 74 is preferably made of aluminum and may have a thickness of approximately 1–3 mils. Adhesive layer 76 and optional layer 78 are preferably formed of the same materials discussed above in reference to adhesive layer 38 and optional layer 40 in the embodiment illustrated in FIG. 3. An example of layered material 67 which has been constructed and has proven satisfactory will now be detailed:

Example 8

In this sample, which is designed for use when container 10 is formed of polyethylene, sealing layer 68 is formed of polyethylene and has a thickness of approximately 1 mil. Layer 70 is formed of natural rubber pressure sensitive adhesive, and has a thickness of approximately 0.1–0.2 mils. The layer 72 of polymeric film and layer 74 of metallic foil are formed of a commercially available laminate which is available from Aluminum Company of America, Alcoa Center, Pa. Layer 72 is formed of polypropylene and has a thickness of approximately 1.5 mils. Metallic foil 74 is formed as a sheet of aluminum foil having a thickness of approximately 1 mil. Adhesive layer 76 and optional layer 78 were not included in this sample.

Figure 7:
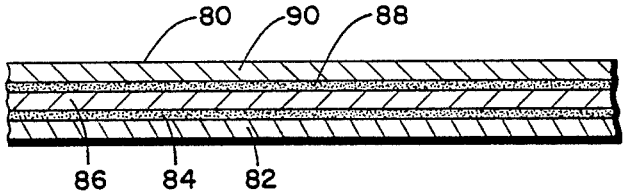
FIG. 7 is a fragmentary cross-sectional view of a fifth embodiment of the innerseal illustrated in FIG. 2.

Referring now to FIG. 7, a layered material 80 constructed according to a fifth embodiment of the invention is illustrated. Layered material 80 includes a sealing layer 82, an adhesive layer 84, a layer 86 of metallic foil, an optional aesthetic layer 90 and an adhesive layer 88 for bonding optional layer 90 to metallic foil 86 if needed. Sealing layer 82 is preferably formed of a polymeric film having a thickness of approximately 1–1.5 mils. This embodiment is characterized by an exceptionally strong bond between sealing layer 82 and container 10, which may be created by applying more heat during the sealing process than is applied in the previously described embodiments. Materials which may be used to form sealing layer 82 include polyethylene, polypropylene, ethylene vinyl acetate, Surlyn brand 1702 resin or an equivalent material. Adhesive layer 84 may be formed of any known adhesive capable of bonding one of the materials listed above in reference to sealing layer 82 to a layer of metallic foil, such as Adcote 503A laminating adhesive. Metallic foil 86 is preferably formed of aluminum or an equivalent material which may be heated inductively and is effective in preventing passage of fluid therethrough. Optional layer 90 and adhesive layer 88 are constructed according to the same materials discussed above with reference to optional layer 40 and adhesive layer 38 in the embodiment illustrated in FIG. 3.

An example of a layered material 80 which has been constructed and has proven satisfactory in operation will now be detailed:

Example 9

This sample, which was designed for use when container 10 is formed of polyethylene, includes a sealing layer 82 which is formed of polyethylene film having a thickness of approximately 1 mil. Adhesive layer 84 is formed of Adcote 503A laminating adhesive. Layer 86 is formed of aluminum foil having a thickness of approximately 1 mil. In this sample, optional layer 90 and adhesive layer 88 are not included.

Figure 8:
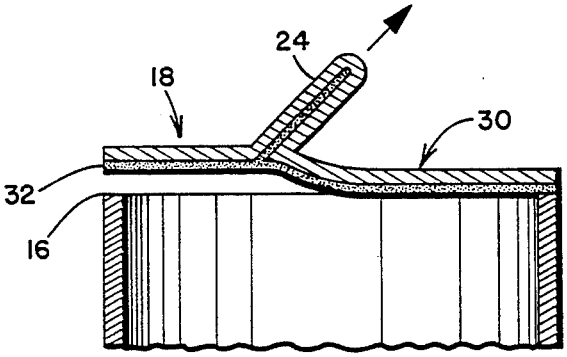
FIG. 8 is a diagrammatical view of an innerseal constructed according to the embodiment of FIG. 3 being removed from the container.

Referring now to FIG. 8, when an innerseal 18 constructed according to the embodiment illustrated in FIG. 3 is removed by pulling fold-over portion 24 in the direction indicated by the arrow, the bond between sealing layer 32 of layered material 30 and rim 16 is relatively weak compared to the bond between the various layers in layered material 30. As a result, the lower surface of layered material 30 separates cleanly from rim 16 when innerseal 18 is being removed.

Figure 9:
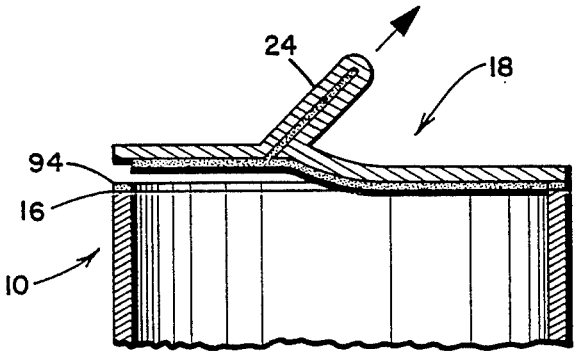
FIG. 9 is a diagrammatical view of an innerseal constructed according to the embodiments of FIGS. 4–6 being removed from the container.

Referring now to FIG. 9, the removal of an innerseal 18 which is constructed according to the embodiments depicted in FIGS. 4–6 will now be described. When fold-over portion 24 is pulled in the direction of the arrow, the bond between the edge 94 of the sealing layer, or first bonding portion, and the rim 16 of container 10 is stronger than both the bond between the sealing layer and the second bonding portion and stronger than the rupture strength of the sealing layer. In the case of layered material 42 in the embodiment illustrated in FIG. 4, this means that the bond between sealing layer 44 and rim 16 must be stronger than the bond between adhesive layer 46 and sealing layer 44. In the case of layered material 54 in the embodiment illustrated in FIG. 5, this means that the bond between sealing layer 56 and rim portion 16 must be stronger than the bond between the layer 58 of pressure sensitive adhesive and sealing layer 56. In the case of layered material 67 in the embodiment illustrated in FIG. 6, this means that the bond between sealing layer 68 and rim portion 16 must be stronger than the bond between sealing layer 68 and the layer 70 of pressure sensitive adhesive.

As a result, the edge 94 of the sealing layer which is bonded to rim portion 16 will delaminate from the second bonding portion of the innerseal and then rupture apart from the remainder of the sealing layer, leaving a deposit of the sealing layer around the rim portion 16 of the container when innerseal 18 has been removed.

Figure 10:
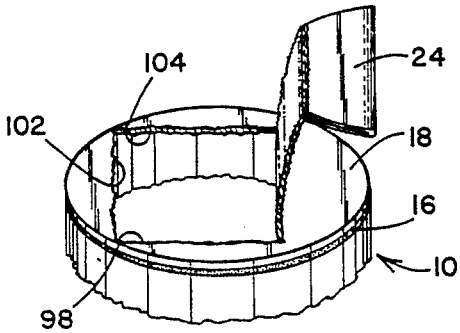
FIG. 10 is a diagrammatical view illustrating an innerseal constructed according to the embodiment depicted in FIG. 7 being removed from the container.

Referring now to FIG. 10, the removal of an innerseal 18 constructed according to the embodiment depicted in FIG. 7 will now be discussed. As discussed in reference to the description of FIG. 7, sealing layer 82 is bonded to container 10 with a greater bonding force than is the case with the embodiments of FIGS. 3–6. When a portion 24 in an innerseal constructed according to the embodiment of FIG. 7 is grasped and pulled in the direction of the arrow, the bond between sealing layer 82 and the rim portion 16 of container 10 is stronger than the tear strength of layered material 90. As a result, layered material 90 will tear along a first edge 102 that is substantially parallel to the folded seam of fold-over portion 24, and second and third tear edges 98, 104 which will advance across the surface of layered material 90 as the fold-over portion 24 continues to be pulled by the user. This seal has the additional advantage of being tamper evident, since it is impossible to remove the innerseal without tearing it.

Figure 11:
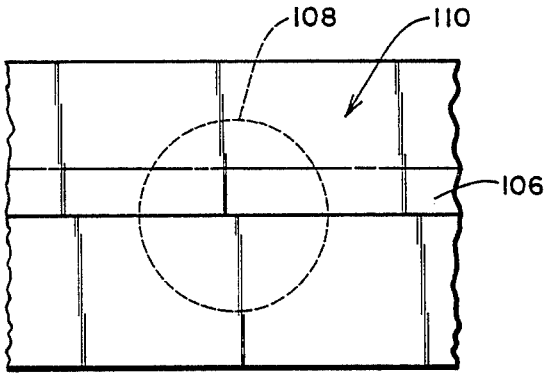
FIG. 11 is a top plan view of a stock material used in forming innerseals according to the invention.

Referring now to FIG. 11, a method for applying an innerseal constructed according to the above-discussed embodiments will now be described. A blank 110 having a folded-over section 106 is provided in sheet form and is made of a desired one of the various layered materials discussed above with reference to the embodiments of FIGS. 3–7. In order to form an innerseal 18, blank 110 is cut along a line 108 which roughly corresponds to the shape of a rim 16 which is to be fitted. After an innerseal 18 has been so formed, the innerseal 18 is placed over the rim 16 of a container 10. The container 10 and innerseal 18 are then passed through an inductive heating station, where the respective sealing layer of the innerseal 18 becomes bonded to the rim 16 of container 10. By adjusting the power setting of the inductive heating station, the degree of bonding of the innerseal 18 to rim 16 can be controlled. In the case of an innerseal according to the embodiment of FIG. 7, a greater percentage of setting inductive leaking force is applied to create a bond with container 10 which is stronger than the rupture strength of the common layer material which forms the innerseal. Accordingly, such an innerseal is removable in the tamper-evident manner illustrated in FIG. 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved innerseal for use with a container of the type having an opening defined by an upper rim, comprising:

first sealing means adapted for sealing over a first portion of the upper rim to close a first portion of the opening;

second sealing means adapted for sealing over a second portion of the upper rim to close a second portion of the opening; and flap means for connecting said first and second sealing means and adapted for gripping by a user, said first sealing means, second sealing means and said flap means being formed of a common multilayer innerseal material, whereby said innerseal may be efficiently manufactured and is convenient to remove from a container.

2. An innerseal according to claim 1, wherein said flap means includes a first flap connected to said first sealing portion, and a second flap connected to said first flap at a first end and to said second sealing portion at a second end.

3. An innerseal according to claim 1, wherein said multilayer material includes membrane means for preventing passage of fluid through said layered material and means adapted for sealing said layered material to the upper rim.

4. An innerseal according to claim 3, wherein said membrane means comprises a layer of metallic foil.

5. An innerseal according to claim 4, wherein said metallic foil is aluminum and has a thickness of between 0.5–3 mils.

6. An innerseal according to claim 3, wherein said sealing means comprises a layer of material selected from the group consisting of Ethylene Vinyl Acetate, polyethylene, polyester, polypropylene, ionomer resins and laminates or blends thereof.

7. An innerseal according to claim 1, wherein said multilayer material comprises means adapted for bonding said first and said second sealing means to the upper rim, said bonding means having a first bonding portion for bonding against the container rim with a first bonding force, and a second bonding portion which is adhered to said first bonding portion with a second bonding force, said fist bonding portion being formed of a material which has a a rupture strength that is less than either said first bonding force or said second bonding force, whereby a first part of said first bonding portion will delaminate from said second bonding portion over the container rim when said flap means is pulled, while a second part of said first bonding portion will remain adhered to said second bonding portion, thereby exposing the opening.

8. An innerseal according to claim 7, wherein said first bonding portion comprises a first bonding strata and said second bonding portion comprises a second bonding strata.

9. An innerseal according to claim 8, wherein said first bonding strata is comprised of a material selected from the group consisting essentially of polyethylene, polyester, polypropylene, and EVA and laminates or blends thereof.

10. An innerseal according to claim 7, wherein said first bonding portion comprises a layer of heat sealable film, and said second bonding portion comprises a layer of pressure sensitive adhesive.

11. An innerseal according to claim 3, wherein said sealing means is adapted to bond to the upper rim with a first bonding force which is greater than a rupture strength of said multilayer material, whereby said layered material will rupture and tear progressively in a tamper-evident manner when said flap means is grasped and pulled by a user.

12. An innerseal according to claim 11, wherein said sealing means comprises a heat sealable layer formed of a material consisting essentially of polyethylene, polyester, polypropylene, and EVA and laminates or blends thereof.

13. An improved container assembly of the type having an innerseal for providing an additional seal between an inner portion thereof and an outside space, comprising:

a container having an opening defined therein by an upper rim thereof;

first sealing means adapted for sealing over a first portion of the upper rim to close a first portion of the opening;

second sealing means adapted for sealing over a second portion of the upper rim to close a second portion of the opening; and flap means for connecting said first and second sealing means and adapted for gripping by a user, said first sealing means, second sealing means and said flap means being formed of a common multilayer innerseal material, whereby said innerseal may be efficiently manufactured and is convenient to remove from said container.

14. An innerseal according to claim 13, wherein said flap means includes a first flap connected to said first sealing portion, and a second flap connected to said first flap at a first end and to said second sealing portion at a second end.

15. An innerseal according to claim 13, wherein said multilayer material includes membrane means for preventing passage of fluid through said multilayer material and means for sealing said multilayer material to said upper rim.

16. An innerseal according to claim 15, wherein said membrane means comprises a layer of metallic foil.

17. An innerseal according to claim 16, wherein said metallic foil is aluminum and has a thickness of between 0.5–3 mils.

18. An innerseal according to claim 15, wherein said sealing means comprises a layer of material selected from the group consisting of ethylene vinyl acetate, polyethylene, polyester, polypropylene, ionomer resins and laminates or blends thereof.

19. An innerseal according to claim 13, wherein said multilayer material comprises means adapted for bonding said first and said second sealing means to the upper rim, said bonding means having a first bonding portion for bonding against the container rim with a first bonding force, and a second bonding portion which is adhered to said first bonding portion with a second bonding force which is less than said first bonding force, said first bonding portion being formed of a material which has a rupture strength that is less than either said first bonding force or said second bonding force, whereby a first part of said first bonding portion will delaminate from said second bonding portion over the container rim when said flap means is pulled, while a second part of said first bonding portion will remain adhered to said second bonding portion, thereby exposing the opening.

20. An innerseal according to claim 19, wherein said first bonding portion comprises a first bonding strata and said second bonding portion comprises a second bonding strata.

21. An innerseal according to claim 20, wherein said first bonding strata is comprised of a material selected from the group consisting essentially of polyethylene, polyester, polypropylene, and EVA and laminates or blends thereof.

22. An innerseal according to claim 19, wherein said first bonding portion comprises a layer of heat sealable film, and said second bonding portion comprises a layer of pressure sensitive adhesive.

23. An innerseal according to claim 15, wherein said sealing means is adapted to bond to the upper rim with a first bonding force which is greater than a rupture strength of said multilayer material, whereby said multilayer material will rupture and tear progressively in a tamper-evident manner when said flap means is grasped and pulled by a user.

24. An innerseal according to claim 23, wherein said sealing means comprises a heat sealable layer formed of a material consisting essentially of polyethylene, polyester, polypropylene, and EVA and laminates or blends thereof.

25. An improved innerseal for use with a container of the type having an opening defined by an upper rim, comprising:

first sealing means adapted for sealing over a first portion of the upper rim to close a first portion of the opening;

second sealing means adapted for sealing over a second portion of the upper rim to close a second remaining portion of the opening; and flap means connecting said first and second sealing means and adapted for gripping by a user, said first sealing means and said second sealing means being formed of a common layered material, said common layered material comprising means adapted for bonding said first and second sealing means to the upper rim, said bonding means having a first bonding portion for bonding against the container rim with a first bonding force, and a second bonding portion which is adhered to said first bonding portion with a second bonding force which is less than said first bonding force, said first bonding portion being formed of a material which has a rupture strength that is less than either said first bonding force or said second bonding force, whereby a first part of said first bonding portion will delaminate from said second bonding portion over the container rim when said flap means is pulled, while a second part of said first bonding portion will remain adhered to said second bonding portion, thereby exposing the opening.

26. An improved innerseal for use with a container of the type having an opening defined by an upper rim, comprising:

first sealing means adapted for sealing over a first portion of the upper rim to close a first portion of the opening;

second sealing means adapted for sealing over a second portion of the upper rim to close a second remaining portion of the opening; and flap means connecting said first and second sealing means and adapted for gripping by a user, said first sealing means and second sealing means being formed of a common layered material which includes membrane means for preventing passage of fluid through said layered material and means for adapted for sealing said layered material to the upper rim, said sealing means being adapted to bond to the upper rim with a first bonding force which is greater than a rupture strength of said layered material, whereby said layered material will rupture and tear progressively in a tamper-evident manner when said flat means is grasped and pulled by a user.

27. An improved innerseal for use with a container of the type having an opening defined by an upper rim, comprising:

first sealing means adapted for sealing over a first portion of the upper rim to close a first portion of the opening;

second sealing means adapted for sealing over a second portion of the upper rim to close a second remaining portion of the opening; and flap means connecting said first and second sealing means and adapted for gripping by a user, said first sealing means and second sealing means being formed of a common layered material which includes membrane means for preventing passage of fluid through said layered material and means adapted for sealing said layered material to the upper rim, said sealing means being adapted to bond to the upper rim with a first bonding force that is less than internal bonding forces in said layered material, whereby said layered material will cleanly separate from the upper rim when said flap means is pulled.

28. An improved container assembly of the type having an innerseal or providing an additional seal between an inner portion thereof and an outside space comprising:

a container having an opening defined therein by an upper rim thereof;

first sealing means adapted for sealing over a first portion of the upper rim to close a first portion of the opening;

second sealing means adapted for sealing over a second portion of the upper rim to close a second remaining portion of the opening; and flap means connecting said first and second sealing means and adapted for gripping by a user, said first sealing means and said second sealing means being formed of a common layered material, said common layered material comprising means adapted for bonding said first and second sealing means to the upper rim, said bonding means having a first bonding portion for bonding against the container rim with a first bonding force, and a second bonding portion which is adhered to said first bonding portion with a second bonding force which is less than said first bonding force, said first bonding portion being formed of a material which has a rupture strength that is less than either said first bonding force or said second bonding force, whereby a first part of said first bonding portion will delaminate rom said second bonding portion over the container rim when said flap means is pulled, while a second part of said first bonding portion will remain adhered to said second bonding portion, thereby exposing the opening.

29. An improved container assembly of the type having an innerseal for providing an additional seal between an inner portion thereof and an outside space comprising:

a container having an opening defined therein by an upper rim thereof;

first sealing means adapted for sealing over a first portion of the upper rim to close a first portion of the opening;

second sealing means adapted for sealing over a second portion of the upper rim to close a second remaining portion of the opening; and flap means connecting said first and second sealing means and adapted for gripping by a user, said first sealing means and second sealing means being formed of a common layered material which includes membrane means for preventing passage of fluid through said layered material and means for adapted for sealing said layered material to the upper rim, wherein said sealing means is adapted to bond to the upper rim with a first bonding force which is greater than a rupture strength of said layered material, whereby said layered material will rupture and tear progressively in a tamper-evident manner when said flap means is grasped and pulled by a user.

30. An improved container assembly of the type having an innerseal for providing an additional seal between an inner portion thereof and an outside space comprising:

a container having an opening defined therein by an upper rim thereof;

first sealing means adapted for sealing over a first portion of the upper rim to close a first portion of the opening;

second sealing means adapted for sealing over a second portion of the upper rim to close a second remaining portion of the opening; and flap means connecting said first and second sealing means and adapted for gripping by a user, said first sealing means and second sealing means being formed of a common layered material which includes membrane means for preventing passage of fluid through said layered material and means adapted for sealing said layered material to the upper rim, said sealing means being adapted to bond to the upper rim with a first bonding force that is less than internal bonding forces in said layered material, whereby said layered material will cleanly separate from the upper rim when said flap means is pulled.

* * * * *

UNITED STATES PATENT AND TRADEMARK OFFICE

CERTIFICATE OF CORRECTION

PATENT NO. : 4,934,544

DATED : June 19, 1990

INVENTOR(S) : Han, et al.

It is certified that error appears in the above-identified patent and that said Letters Patent is hereby corrected as shown below:

Col. 4, line 21, "commercial" should read --commercially--.

Col. 4, lines 16 & 17, "Scotchpak TM" should read --Scotchpak™--. (twice)

Col. 4, lines 28 & 29, "Scotchpak TM" should read --Scotchpak™--.

Col. 4, line 38, "ScotchpakTM" should read --Scotchpak™--.

Col. 4, line 40, "Scotchpak TM" should read --Scotchpak™--.

Col. 5, line 1, "or" should read --of--.

Col. 6, line 10, "Kraton R" should read --Kraton®--.

Signed and Sealed this

Second Day of March, 1993

*Attest:*

STEPHEN G. KUNIN

*Attesting Officer*

*Acting Commissioner of Patents and Trademarks*